US005715644A

United States Patent [19]

Yasui

[11] Patent Number: 5,715,644

[45] Date of Patent: Feb. 10, 1998

[54] SUPERPLASTICALLY FORMED, DIFFUSION BONDED PANELS WITH DIAGONAL REINFORCING WEBS AND METHOD OF MANUFACTURE

[75] Inventor: Ken K. Yasui, Huntington Beach, Calif.

[73] Assignee: McDonnell Douglas Corporation, Huntington Beach, Calif.

[21] Appl. No.: 696,299

[22] Filed: Aug. 13, 1996

[51] Int. Cl.[6] ..... A47B 13/08

[52] U.S. Cl. ..... 52/784.14; 52/783.19; 52/783.16; 228/157

[58] Field of Search ..... 52/784.14, 783.14, 52/783.15, 783.16, 783.17, 783.19, 694, 695, 635; 228/157

[56] References Cited

U.S. PATENT DOCUMENTS

| | | | |
|---|---|---|---|
| 3,927,817 | 12/1975 | Hamilton et al. | 228/157 |
| 4,217,397 | 8/1980 | Hayase et al. | 228/157 X |
| 4,292,375 | 9/1981 | Ko . | |
| 4,304,821 | 12/1981 | Hayase et al. . | |
| 4,351,470 | 9/1982 | Swadling et al. . | |
| 4,530,197 | 7/1985 | Rainville | 52/783.15 |
| 5,055,143 | 10/1991 | Runyan et al. . | |
| 5,069,383 | 12/1991 | Cooper et al. . | |
| 5,129,248 | 7/1992 | Yasui . | |
| 5,289,965 | 3/1994 | Yasui et al. | 228/157 |
| 5,323,953 | 6/1994 | Adderley et al. | 228/157 |
| 5,330,092 | 7/1994 | Gregg et al. | 228/157 |
| 5,330,093 | 7/1994 | Bottomley et al. . | |
| 5,413,271 | 5/1995 | Mansbridge et al. . | |
| 5,603,449 | 2/1997 | Mansbridge et al. | 228/157 |

*Primary Examiner*—Creighton Smith

*Attorney, Agent, or Firm*—The Bell Seltzer Intellectual Property Law Group of Alston & Bird LLP

[57] ABSTRACT

SPF/DB structures having diagonal reinforcement webs and processes for the formation of the structures allow greater vertical web height to spacing to be formed. The diagonal webs are constructed by adding at least two additional sheets in the center of a prior art four sheet SPF/DB process. The additional sheets are welded to sheets that will become vertical webs centrally between the webs. When the core assembly so formed is superplastically deformed, the additional sheets are stretched into diagonal webs, which may be longitudinal, lateral, at an angle, or a combination to form truncated pyramidal reinforcements contained in rectangular cells, truncated hexagonal reinforcements of hexagonal cells or diagonally reinforced rows.

14 Claims, 8 Drawing Sheets

SUPERPLASTICALLY FORMED, DIFFUSION BONDED PANELS WITH DIAGONAL REINFORCING WEBS AND METHOD OF MANUFACTURE

BACKGROUND OF THE INVENTION

Superplasticity is the characteristic demonstrated by certain metals to develop unusually high tensile elongation with minimum necking when deformed within a limited temperature and strain-rate range. This characteristic, peculiar to certain metal and metal alloys, has been known in the art as applied to production of complex shapes. It is further known that at the same superplastic-forming temperatures, the same materials can be diffusion-bonded by forcing contacting surfaces together. Many prior art processes and structures use diffusion bonding and superplastic forming, such as shown in: Hamilton et al., U.S. Pat. No. 3,927,817; Ko, U.S. Pat. No. 4,292,375; Rainville, U.S. Pat. No. 4,530,197; Cooper et al., U.S. Pat. No. 5,069,383; and Bottomley et al., U.S. Pat. No. 5,330,093 which must include a maskant or "stop off" material to prevent unwanted bonding, and Blair, U.S. Pat. No. 4,318,965; Violette et al., U.S. Pat. No. 5,129,787; Gregg et al., U.S. Pat. No. 5,330,092; Matsen, U.S. Pat. No. 5,420,400; and Gregg et al., U.S. Pat. No. 5,451,472 which disclose superplastically formed diagonally reinforced structures and the processes to construct the same.

As shown in Hayase, et al., U.S. Pat. No. 4,217,397, four sheets of superplastically formable material, such as titanium alloy can be used to provide a metallic sandwich structure. Generally, two or three contiguous work sheets are joined together by a distinct continuous seam weld in a pre-selected pattern, which determines the geometry of the structure of the core to be produced. An expandable envelope is formed by sealing the perimeter of the joined sheets. The joined and unjoined work sheets are then placed in a stacked relationship and contained in a limiting fixture or die. The space between the upper and lower limiting fixture members determines the height and shape of the sandwich structure that ultimately results. At least one of the work sheets is then superplastically formed against the other work sheet, to which it becomes diffusion-bonded to form the desired sandwich structure.

A particularly advantageous structure that can be formed is a four-sheet structure that ultimately results in two generally parallel face-sheets with perpendicular webs extending there between. The webs are formed by two sheets, which are intermittently welded together along a seam there between. When pressurized during a superplastic forming operation, the spaces between the two welded sheets expand into balloon-like structures until they contact the face sheets and can expand outwardly no more. The face sheets, are held in a proper final position inside forming dies in a hot press. Application of continuing pressure causes the balloon-like structures to assume square shapes with the seams being positioned halfway between the face sheets on the perpendicular webs. The sheets adjacent the web ultimately are bent 90° into contact with each other, and diffusion-bonded together into a single structure. Heretofore, such four-sheet superplastically formed, diffusion-bonded (SPF/DB) structures have been limited to a one-to-one ratio between web spacing and panel thickness, because when webs are more closely spaced, the web material is over-strained and either ruptures because of excessive material thinning and also web spacing becomes inconsistent because of imbalance of horizontal force components during of the SPF process.

When web spacing is less than the panel thickness, which is the separation between the face-sheets, any inconsistency in weld location or material thickness, or temperature variation may cause differences in cell size. Larger cells form faster than adjacent smaller cells because of higher stress and unbalanced pulling forces. When the cells eventually contact the face sheets, inconsistent spacings of the vertical webs are created. Therefore, because of the limitations in the forming process, four-sheet SPF/DB panels cannot have close web spacing. Without close web spacing, the face sheets buckle prematurely or the face-sheets and webs become unnecessarily heavy; so heavy, in fact, that such structures are not as weight-efficient as honeycomb or other expanded core structures, wherein an efficient panel structure is formed of two face sheets sufficiently separated by a low-density core material.

Therefore, there has been a need to improve the basic four-sheet SPF/DB process so that SPF/DB processes can be used to fabricate consistently-formed panels where face sheet connecting webs are relatively tall with respect to the spacing between the webs.

BRIEF DESCRIPTION OF THE INVENTION

In the present process, two relatively thin sheets are added to the center of the core of a four-sheet SPF/DB assembly, so that six sheets result. The two additional sheets have small gas transmission holes formed therein at strategic locations so that a pressure differential never develops across the additional sheets.

In forming the stack of sheets to perform the present six-sheet process, each of two normal web forming sheets is connected to an adjacent diagonal web forming sheet with a weld attachment. If only longitudinal webs are to be formed usually two spaced parallel weld beads are used, which result in a relatively wide, linear, diffusion bonded joint there between. If square cells with both longitudinal and transverse webs are to be formed, then each the diagonal web forming sheet is attached to a normal web forming sheet at what will be the center of the cell either by means of a spot weld or a narrow weld bead about the periphery of the attachment. The two assemblies of normal and diagonal web forming sheets are then welded together at intermittent locations along lines as if the standard four-sheet process was being performed and as if the now-facing additional two center sheets were not present. Face sheets are added to the stack and the edges are sealed with a first pressure line connected to the area between the inner core and the face sheets and a second pressure line connected to the inner core. This assembly is then placed in a die in a hot press, the assembly is heated to about 1650° F. and a controlled flow of inert gas is introduced between the inner core and the face sheets to superplastically form the face sheets to the shape of the die. The core sheet forming may be gas-mass controlled as discussed in Yasui, U.S. Pat. No. 5,129,248 and face sheet forming may be accomplished by just maintaining the face sheet forming gas in a pressure range, since face sheet forming is rarely critical. The inert gas causes the face sheets to gradually assume the shape of the die in which the assembly has been placed. A slightly higher pressure is applied to the second pressure line at the same time, so that a slight differential pressure appears between the outer sheets of the inner core to prevent the core sheets from diffusion bonding together during face sheet formation.

When the face sheets have been formed, controlled gas-mass flow is introduced into the inner core, while pressure between the inner core and the face sheets is maintained to keep the face sheets in proper position against the die. As the gas flows, the outer core sheets balloon outwardly between the intermittent welds while the inner core sheets are stretched by the outward process of the centers of the balloons. Since the volume between the face sheets and the core gradually reduces, inert gas is bled out of the first tube through a regulator to maintain face sheet securing pressure. The welds between the inner and outer core sheets and the additional thickness of the inner and outer core sheets in the areas of the welds cause those areas to remain relatively flat, so that normally those areas contact the face sheets first. During this time, the inner core sheets become diagonal braces for the walls formed between adjacent ballooned core sheets. These diagonal braces increase the sheer strength of the panel by resisting column bending of the webs, assist in maintaining the spacing of closely spaced webs, reduce the requirement for closely spaced webs, and prevent the webs from becoming excessively thin. While controlled gas-mass flow is being used, the pressure being exerted is monitored. The pressure characteristically rises faster toward the end of the core forming process to indicate that no more expansion of the core sheets is occurring, at which time the pressure at the first tube can be relieved to lower pressure.

When the process is complete, an SPF/DB panel results which has perpendicular webs between the face sheets, and diagonal braces between the centers of the webs and each adjacent face sheet. If, transverse and longitudinal webs are desired so that the resultant panel has similar sheer strength in orthogonal directions and enhanced compressive strength, then a criss-crossed pattern of interrupted welds are formed after the inner and outer core sheets have been welded together in what will become the center of a square cell construction. Thereafter, the structure is heated and formed as before, resulting in evenly spaced orthogonal webs with two diagonal tent-like structures supporting and maintaining the webs and/or the face sheets in proper position in each cell.

Therefore, it is an object of the present invention to improve upon standard SPF/DB four sheet processes, especially when it is desired to have web spacing, which is small in relation to web height in the panel.

Another object is to improve the sheer characteristics of perpendicular web four-sheet SPF/DB panels.

Another object is to provide a method to prevent excessive thinning of webs in an SPF/DB panel.

Another object is to provide a method to improve the precision formation of support webs in an SPF/DB panel.

These and other objects and advantages of the present invention will become apparent to those skilled in the art after considering the following detailed specification, together with the accompanying drawings wherein:

DETAILED DESCRIPTION OF THE SHOWN EMBODIMENTS

Figure 1:
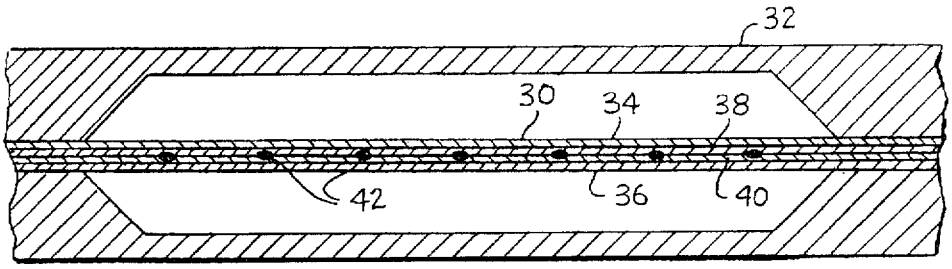
FIG. 1 is a cross-sectional view of a four-sheet assembly for constructing a prior art SPF/DB panel in place in a heated die prior to the application of pressure.

Referring to the drawings more particularly by reference numbers, number 30 in FIG. 1 refers to a prior art four sheet fabrication assembly positioned in a hot die 32 for the performance of a superplastic forming, diffusion bonding (SPF/DB) process. The assembly 30 includes upper and lower face sheets 34 and 36 and upper and lower inner core sheets 38 and 40. The material of the sheets 34, 36, 38, and 40 to be superplastically formed must exhibit the characteristic of unusually high tensile elongation with minimum necking when deformed within a limited temperature and strain rate range. Titanium alloys are the preferred sheet material although some other alloys are also superplastically formable. The superplastic temperature range varies with the specific alloy used. This temperature for most titanium alloys is between 1400° F. and 1750° F. The strain is easily controlled by using the controlled gas-mass flow method discussed above. If the strain rate is too rapid the sheet material being deformed will blow out and if the rate is too slow the material looses some of its plasticity, and the process costs are increased by excessive labor and energy usage, and the reduced production availability of expensive hot press resources.

The material of the sheets 34, 36, 38, and 40 also must be suitable for diffusion bonding. Diffusion bonding refers to the solid state joining of surfaces of similar or dissimilar metals by applying heat and pressure for a time duration long enough to cause co-mingling of the atoms at the joint interface. This is distinguished from fusion bonding or welding, which is the metallurgical joining or welding of surfaces of similar or dissimilar metals by applying enough heat to cause the materials at the joint interface to reach liquid or plastic state and thereby merge into an integral solid.

Figure 2:
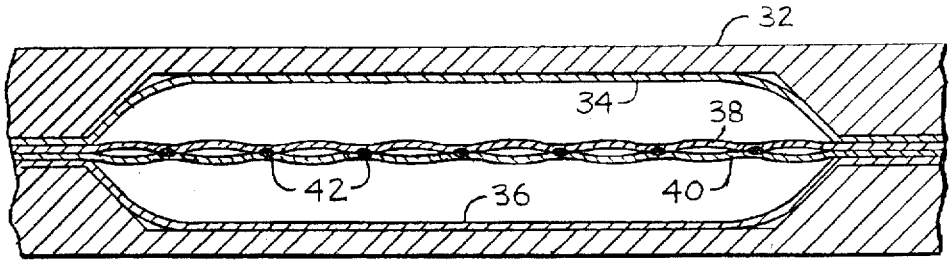
FIG. 2 is a cross-sectional view of the four-sheet assembly of FIG. 1 where the face sheets thereof are just about formed into their final position within the die.

The assembly 30 of FIG. 1 has its core sheets 38 and 40 connected by linear welds 42, at least part of which are intermittent to allow gas flow along the mating surfaces of the sheets 38 and 40. To perform the forming and bonding process, the assembly 30 is heated to the aforementioned approximately 1650° F. for the most common Ti-6Al-4V alloy and pressurized inert gas is introduced between the sheets 34, 36, 38, and 40 of the assembly 30. This causes the face sheets 34 and 36 to superplastically deform outwardly as shown in FIG. 2 into the shape of the die 32. A slightly higher pressure is applied between the core sheets 38 and 40 so that they move only a minimum amount and do not diffusion bond together.

Figure 3:
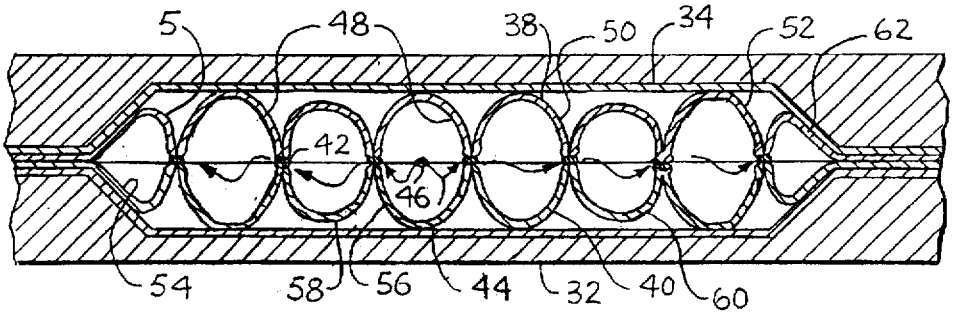
FIG. 3 is a cross-sectional view of the four-sheet assembly of FIGS. 1 and 2 where the core sheets thereof are being formed, possible inaccuracies being exaggerated.

Once the face sheets 34 and 36 have reached their final positions against the die 32, as shown in FIG. 3, the pressure of the inert gas between the face sheet 34 and the core sheet 38 and the face sheet 36 and core sheet 40 is held at a value sufficient to maintain the face sheets 34 and 36 in position. Generally, about 50 psi is maintained with additional pressure being required when thick face sheets 34 and 36 are used. Thereafter sufficient pressurized inert gas is introduced between the core sheets 38 and 40 to cause them to balloon outwardly except where connected together by the intermittent linear welds 42. If, for example, the inert gas 44 is introduced through a passageway 46 at the back of longitudinal "balloon" 48, the gas 44 travels through openings formed by the intermittent portions of the welds 42 to pressurize all of the balloons. Unfortunately, as can be seen in FIG. 3 there are many ways for the prior art four sheet process to go awry.

Figure 4:
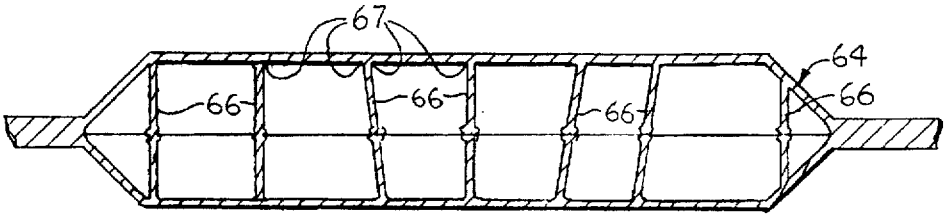
FIG. 4 is a view of the panel being formed in FIGS. 1, 2 and 3 after forming is complete, showing out of position and angled webs therein.

In the panel whose formation is shown in FIG. 3, the object is to create vertical web structures equally spaced between the face sheets 34 and 36 by deformation of the core sheets 38 and 40 into rectangular cross-section longitudinal cells, having a vertical web height greater than the horizontal distance between webs. Either because of material inconsistencies or differences in the distances between the welds, what is in fact happening is that some of the balloons 48, 50 and 52, have reached the face sheets 34 and 36 before other balloons 54, 56, 58, 60 and 62 and also some of the welds 42 have moved out of alignment. The unfavorable result is the diffusion bonded panel structure 64 shown in FIG. 4, which has non-equally spaced and non-vertical webs 66. Although the errors in structure 64 are exaggerated for illustration purposes, such variation from finished panel to finished panel 64 is unacceptable requiring thicker and heavier face sheets to assure proper strength, or the adding of additional webs. By adding additional webs 66, the height to width ratio increases causing more inaccuracies and excessive thinning at the corners 67.

Therefore, there has been a need to improve the basic four sheet SPF/DB process, which assures vertical and constant spacing of the webs while increasing the sheer strength of the finished panel and allowing more weight efficient panel structures.

Figure 5:
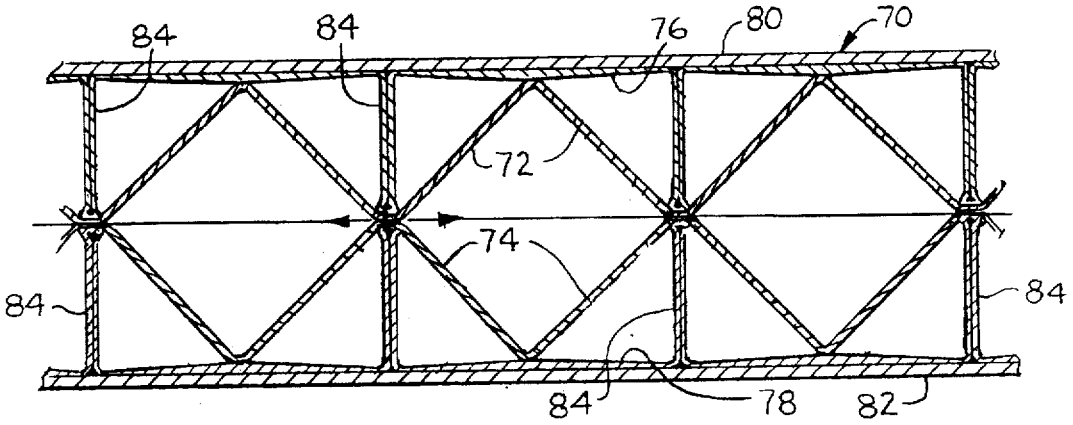
FIG. 5 is a cross-sectional view of an SPF/DB six-sheet panel structure constructed according to the present invention with diagonal reinforcing webs.

A diagonally reinforced web SPF/DB panel 70 constructed according to the present invention with a relatively high height to width ratio is shown in FIG. 5. The panel 70 is similar to panel 64 except that two additional core sheets 72 and 74 are added to the assembly 30 between core sheets 76 and 78 and face sheets 80 and 82, resulting in a six sheet process. In addition to allowing the reduction of the spacing between the vertical webs 84, the diagonal webs 72 and 74 create a more efficient panel 70, much more resistant to shear loads than panels 64 constructed with only vertically positioned parallel webs 66.

Figure 6:
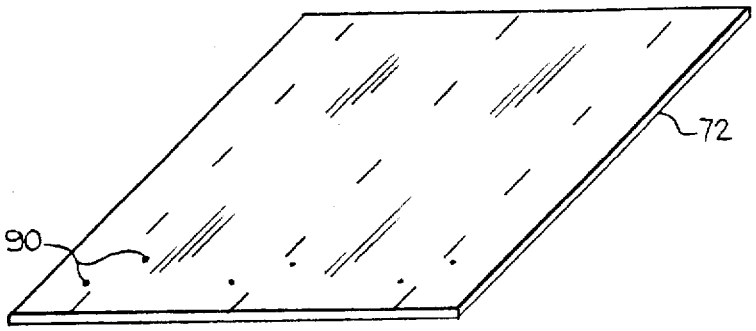
FIG. 6 is a perspective view of one of the two inner core sheets used to form the structure of FIG. 5 with gas passages and the position of the webs of the longitudinal cell structures to be formed shown.
Figure 7:
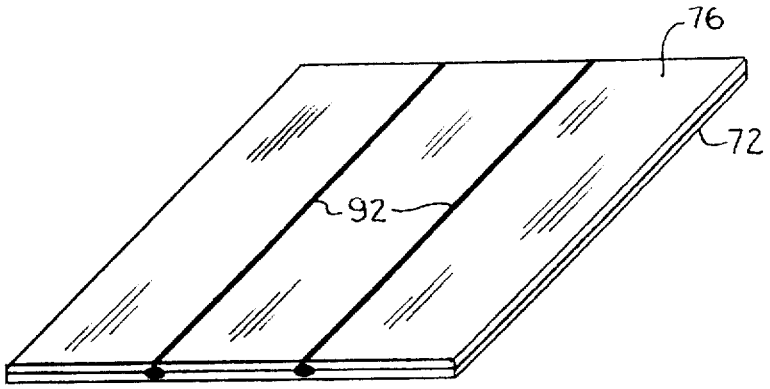
FIG. 7 is a perspective view of one of two inner pairs of core sheets including the sheet of FIG. 6 used to form the structure of FIG. 5 with the welds holding them together shown.
Figure 8:
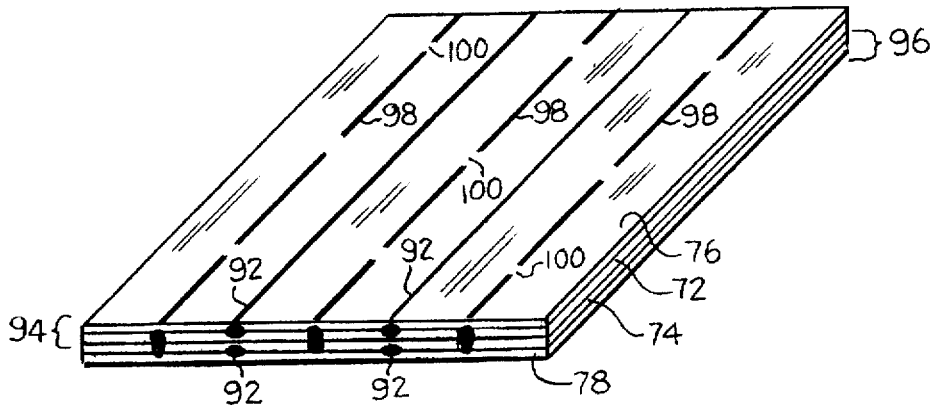
FIG. 8 is a perspective view of two pairs of the core sheets of FIG. 7 as they are welded together to form a core assembly for the panel of FIG. 5.

Various configurations of diagonally reinforced SPF/DB panel structures are possible. The basic fabrication process is relatively simple and similar to other multi-sheet SPF/DB panels. The panel 70 is constructed by first forming gas passageways 90 in core sheets 72 and 74 as shown with sheet 72 in FIG. 6. Thereafter as shown in FIG. 7, sheets 72 and 76 and 74 and 78 are rollseam welded together. The rollseam welds 92 so created become the diagonal web attachment lines at the face sheets after forming. As shown in FIG. 8, the two welded subassemblies 94 and 96 made from sheets 72 and 76, and 74 and 78 respectively, are placed on top of each other with the weld lines 92 aligned. The subassemblies 94 and 96 are then intermittently rollseam welded together to form intermittent welds 98, which become the centers of vertical web locations. After forming, the interruptions 100 in the welds 98 become gas passages during the forming operation that allow gas pressure to equalize across the panel 70.

Figure 9:
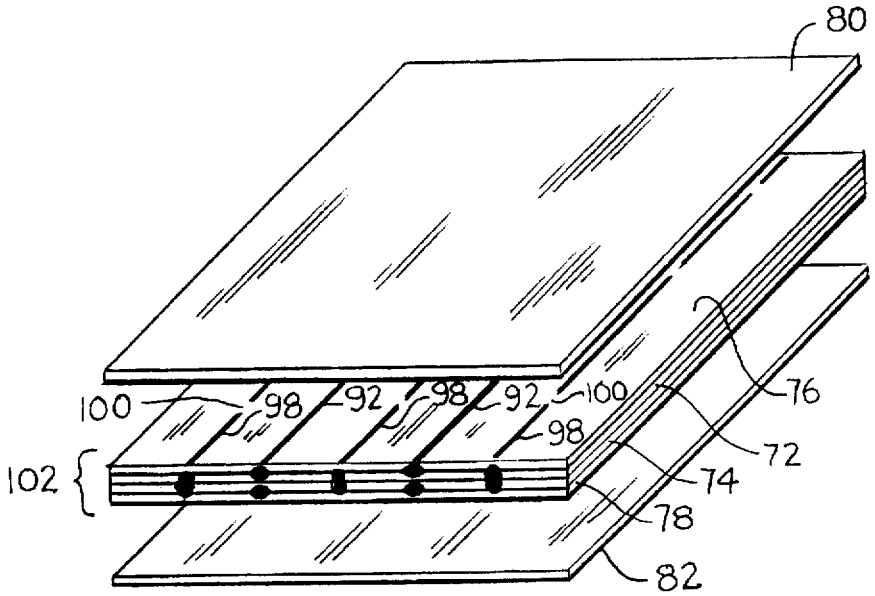
FIG. 9 is a perspective view showing how the face sheets are assembled to the welded core assembly of FIG. 8.
Figure 10:
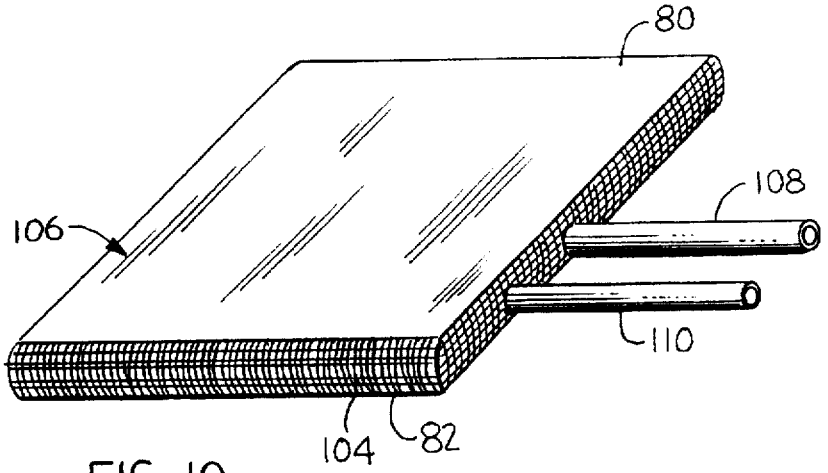
FIG. 10 is a perspective view of the panel assembly used to form the panel of FIG. 5.
Figure 11:
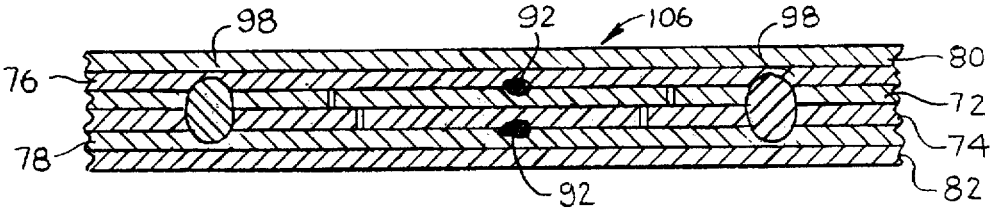
FIG. 11 is an enlarged cross-sectional view of a portion of the panel assembly of FIG. 10 with uni-directional cells.
Figure 12:
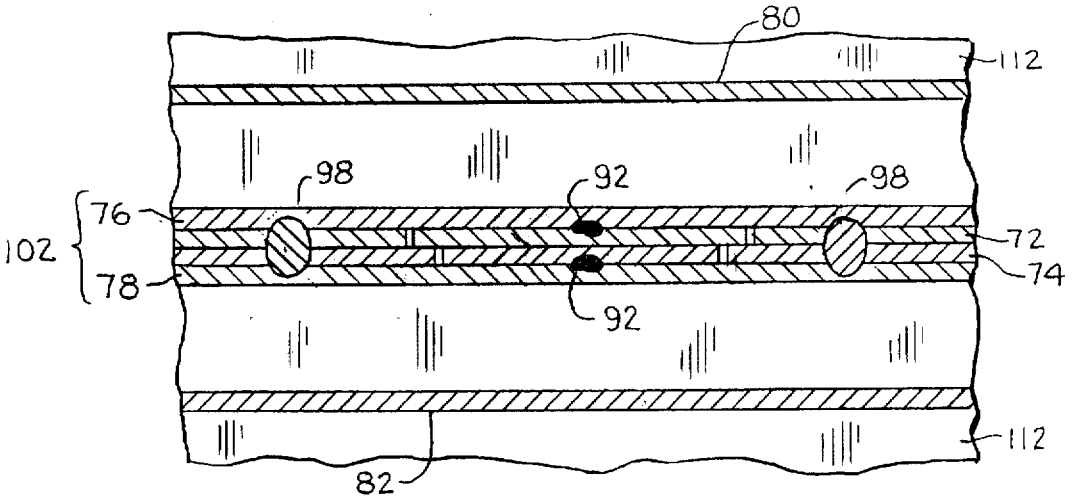
FIG. 12 is a cross-sectional view of the portion of the panel assembly of FIG. 11 in a hot die with the face sheets formed.
Figure 13:
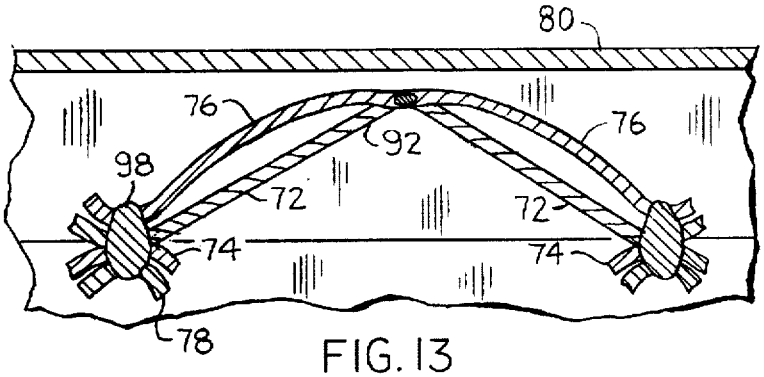
FIG. 13 is a cross-sectional view of the upper half of the portion of the panel assembly of FIG. 12 with the inner core partially formed.

As shown in FIG. 9, the face sheets 80 and 82 are then added to the core assembly 102. As shown in FIG. 10, the edges 104 of the complete panel assembly 106 are then sealed by welding. Two gas transmission tubes, 108 and 110, are positioned to extend out of the edges 104 the during the edge forming operation. Tube 108 forms a gas passageway into the volume between the face sheets 80 and 82 and the core assembly 102, while tube 110 is forms a gas passageway to the interior of the core assembly 102. The welded panel assembly 106, a portion being shown in an enlarged form in FIG. 11, is then placed in a forming die and superplastically formed and diffusion bonded in a hot press. This accomplished by first heating the assembly 106 and then introducing pressurized inert gas between the face sheets 80 and 82 and the core assembly 102, which causes the face sheets 80 and 82 to deform out against the die 112. The interior of the core assembly 102 is also pressurized to just above the face sheet forming pressure during the period of face sheet deformation to prevent the sheets 72, 74, 76 and 78 from undesirably diffusion bonding together. Thereafter, the pressure between the face sheets 80 and 82 and the core assembly 102 is maintained by bleeding off inert gas while a controlled gas-mass flow of inert gas is fed through tube 110 to pressurize the interior of the core assembly 102. This causes sheets 76 and 78 to superplastically deform outwardly as shown in FIG. 13 while sheets 72 and 74 are strained laterally and maintained planar as shown. The welds 92 tend to stiffen the outer areas of the ballooning sheet 76 and as can be seen in FIG. 13, the welds 92 curve only slightly.

Figure 14:
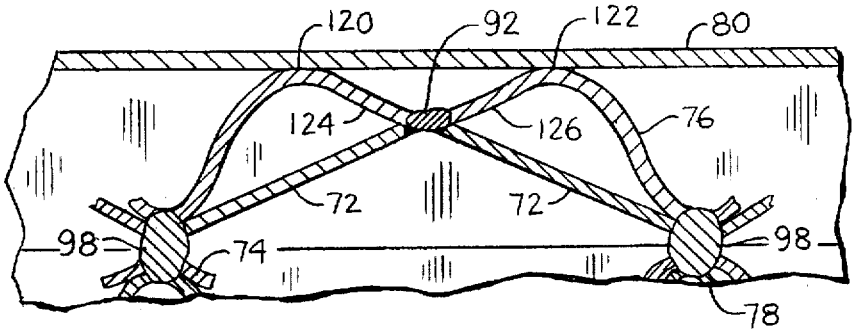
FIG. 14 is a cross-sectional view similar to FIG. 13 illustrating how the core can form if the present process is not followed.
Figure 15:
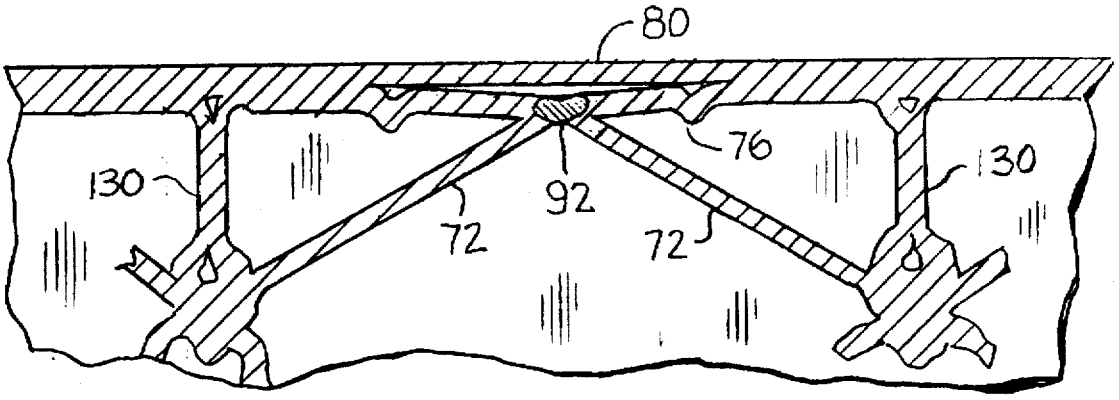
FIG. 15 is a cross-sectional view of the panel that can result from the formation of FIG. 14.

It is important that the welds 92 contact the face sheets 80 and 82 first as expansion continues. If the sheets 72 and 74 are too thick and the welds 92 are too narrow, as shown in FIG. 14, the sheets 76 and 78 can expand beyond the welds 92 engaging the face sheets 80 and 82 first at contact points 120 and 122. Since the material 124 and 126 of the sheet 76 has already been stretched, movement of a weld 92 toward the face sheet 80 causes creasing of the sheet 76 as shown in FIG. 15. Means, not shown, such as vents or wire passages, prevent gas from being trapped in the volume 128, which otherwise can cause the weld 92 to never contact with sufficient pressure to diffusion bond to the face sheet 80.

Figure 16:
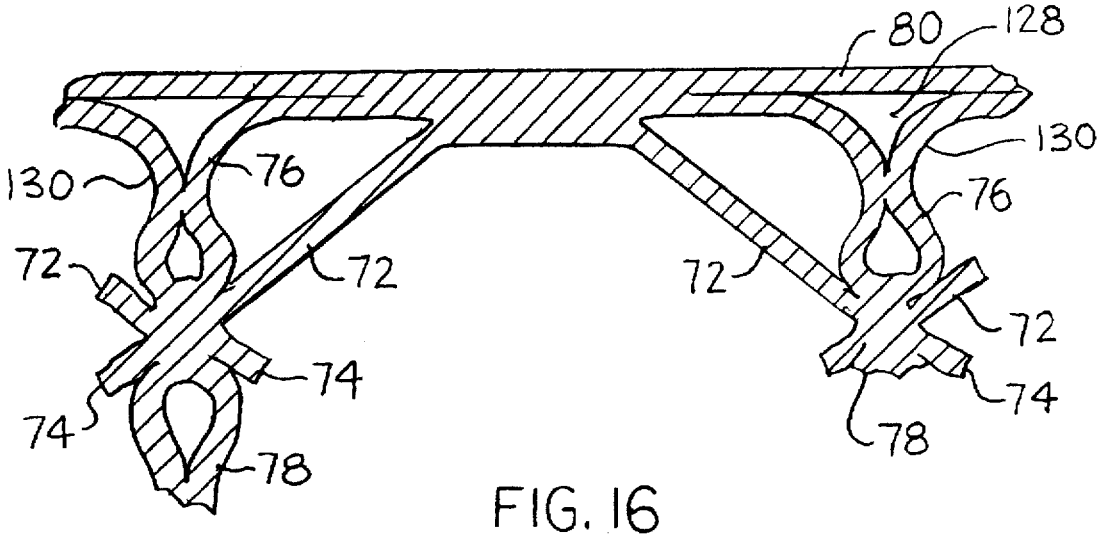
FIG. 16 is a cross-sectional view similar to FIG. 13 illustrating how the core forms when the present process is performed correctly.
Figure 17:
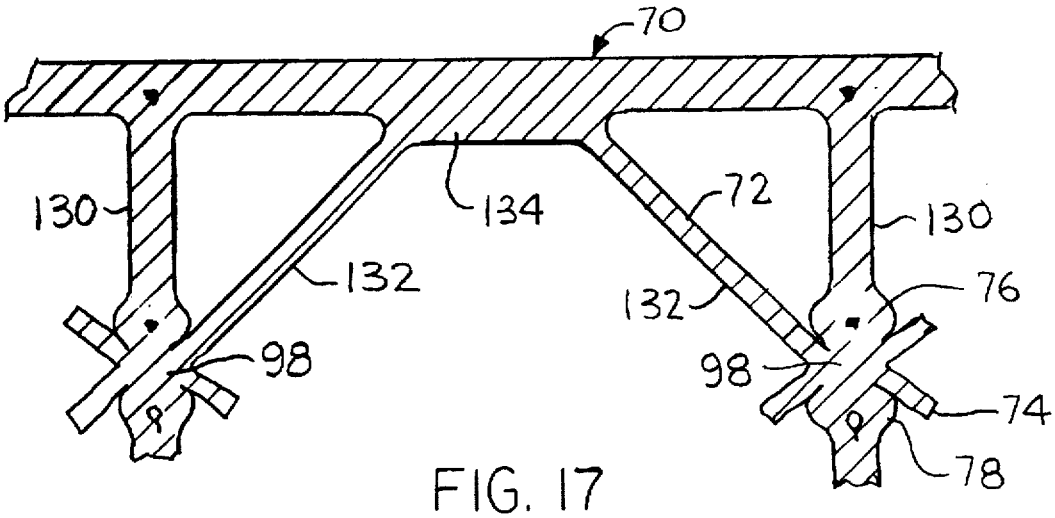
FIG. 17 is a cross-sectional view similar to FIG. 16 showing a correctly completed structure.

If all these aforementioned factors are taken into consideration, the deformations occur properly, as shown in FIG. 16, where the vertical webs 130 are symmetrically forming and diffusion bonding into planar vertical webs 130 with diagonal planar supporting webs 132 extending from the weld area 98 to the face sheet 80, as shown in FIG. 17 where all of the sheets have diffusion bonded together into the integral panel 70.

Figure 18:
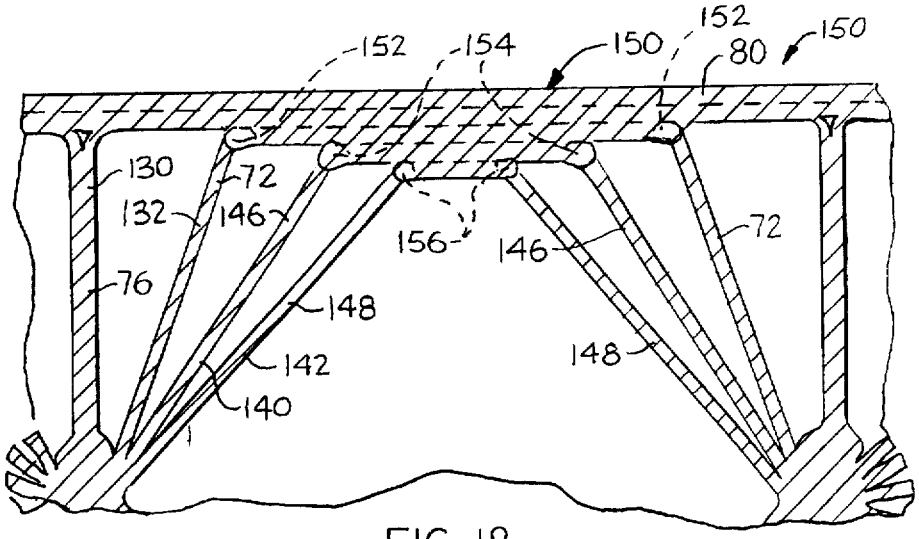
FIG. 18 is a cross-sectional view similar to FIG. 17 of a modified structure having multiple diagonal reinforcing webs.

The present invention is not limited to providing only one set of diagonally formed webs. By adding additional diagonal web sheets 140 and 142 through the center of the original core assembly, additional diagonal reinforcing webs 146 and 148 can be formed to generate the panel 150, a portion of which is shown in FIG. 18. To obtain the needed separation at the face sheet 80, the new sheets 140 and 142 are welded to the outer core sheet 76 with spaced welds 152, 154, and 156, whose spacing is reduced as shown in FIG. 18 to provide separation.

Figure 19:
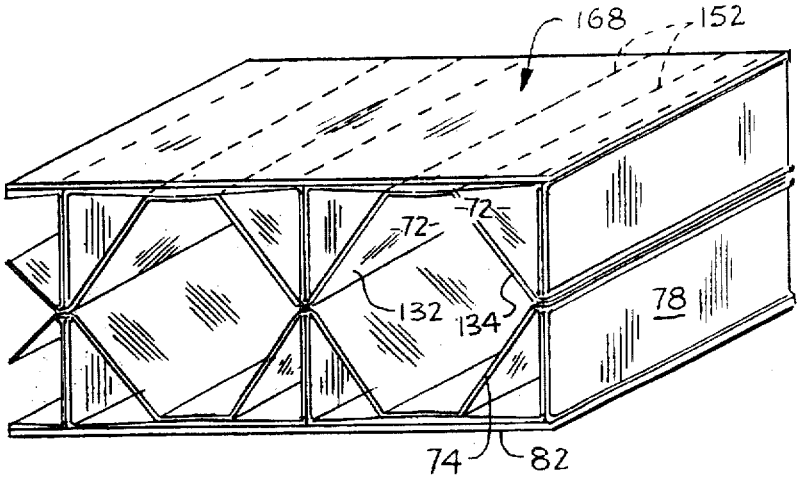
FIG. 19 is a perspective cross-sectional view of a panel structure of FIG. 17 constructed according to the present invention.
Figure 20:
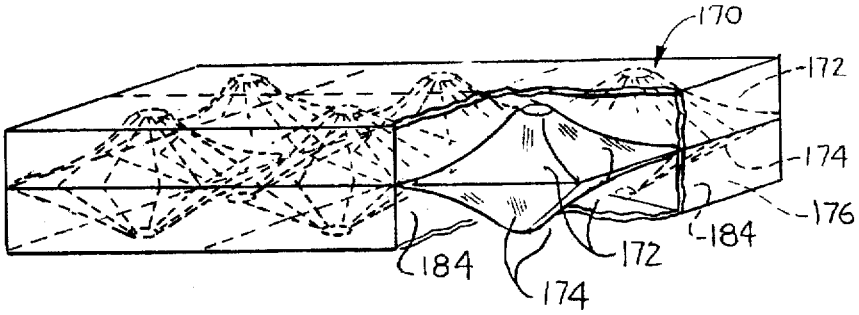
FIG. 20 is a perspective partial cross-sectional view of a panel structure constructed according to the present invention with rectangular cells being formed between longitudinal and transverse ribs with truncated pyramidal-shaped reinforcing webs in each of the cells.
Figure 21:
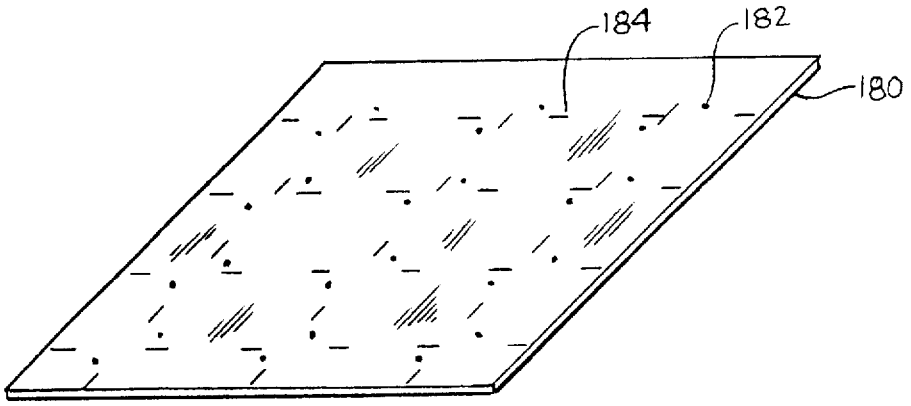
FIG. 21 is a perspective view of one of the two inner core sheets used to form the structure of FIG. 20 with gas passages and the position of the webs of the rectangular cell structures to be formed shown.
Figure 22:
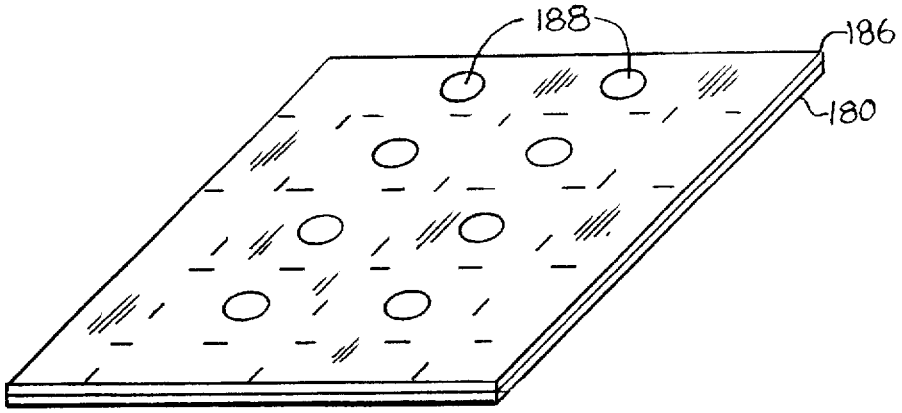
FIG. 22 is a perspective view of one of two inner pairs of core sheets including the sheet of FIG. 21 used to form the structure of FIG. 20 with the cylindrical welds holding them together shown.

If instead of the panel 70 with uni-directional cells as shown in FIG. 19, a panel with bi-directional cells is required, then the panel 170 shown in FIG. 20 can be constructed where the diagonal reinforcing webs 172 and 174 in each cell 176 are in the form of truncated, pyramidal shaped webs. The construction of the panel 170 is similar to the construction of the panel 70. In the inner core sheets 180, gas passages 182 are placed so there is at least one hole 182 in each location where a cell 184, will be constructed. As before, inner core sheets 180 are welded to outer core sheets 186 except that instead of being welded with a linear seam, the welds 188 are symmetrical and are located centrally at what will be the top and bottom of each cell 184 as shown in FIG. 22.

Figure 23:
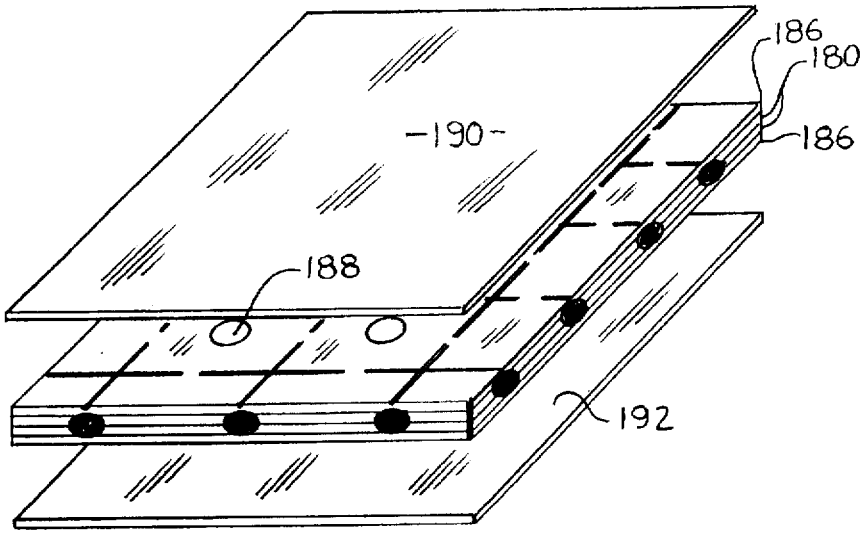
FIG. 23 is a perspective view of two pairs of the core sheets of FIG. 22 as they are welded together to form a core assembly for the panel of FIG. 20 and the face sheets.

As shown in FIG. 23, the inner and outer core sheets 180 and 186 are then welded together at what will become the edges of the cells 184 and face sheets 190 and 192 are applied. The sides are then welded together and the forming process previously described is performed resulting in the truncated, pyramidal webs 172 and 174.

Figure 24:
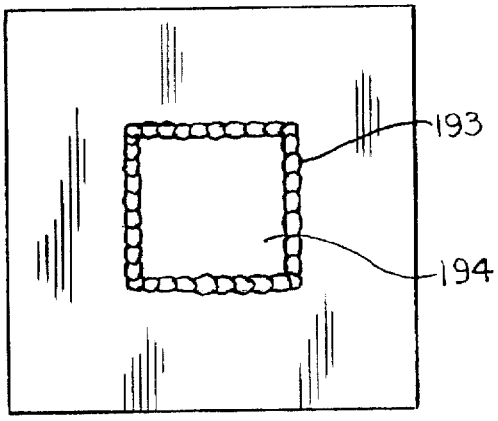
FIG. 24 is an enlarged detail view of a modified structure with a rectangular weld.

Although the welds 188 are shown as cylindrical, as shown in FIG. 24, the welds 188 may be comprised of a rectangle of welds 193 about the edge of a square 194. No interruptions are provided to vent the volume between the welds 193. However, when the sheets are held closely together during the formation of the welds 193, the total volume is so small that diffusion bonding occurs except adjacent the inner edge of the welds 193 where, because of the additional strengthening of the welds 193, an absence of bonding can be tolerated. The welds 193 result in a truncated pyramid with less rounding at its apex.

Figure 25:
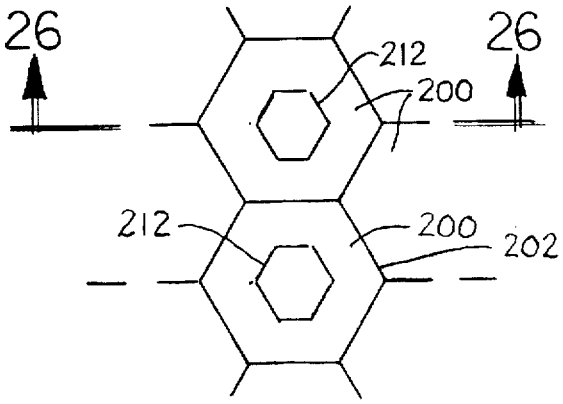
FIG. 25 is an enlarged detail view of a hexagonal cell structure that usually requires an automated welder to form.
Figure 26:
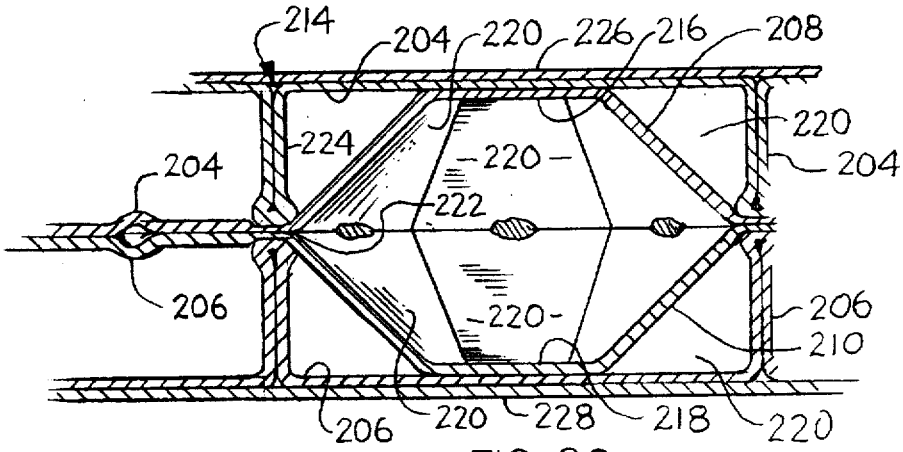
FIG. 26 is a cross-sectional view taken at lines 26—26 of FIG. 25.

As shown in FIGS. 25 and 26, hexagonal cells 200 can be formed using the present six sheet process, although the relatively complex interrupted hexagonal weld pattern 202 between the outer core sheets 204 and 206 requires the use of an automated welding apparatus. The inner core sheets 208 and 210 are welded to the outer core sheets 204 an 206 with a matching hexagonal edge weld 212 like welds 193. The result is a reinforcing structure 214 formed from the inner core sheets 208 and 210 that has a hexagonal top 216 and bottom 218 and twelve symmetrical trapezoidal sides 220 that extend from the weld 212 to centers 222 of the hexagonal webs 224 supporting the diffusion bonded face sheets 226 and 228.

Thus, there has been shown novel SPF/DB structures and the processes by which they are made which fulfill all of the objects and advantages sought therefor. Many changes, alterations, modifications and other uses and applications of the subject invention will become apparent to those skilled in the art after considering the specification together with the accompanying drawing. All such changes, alterations and modifications which do not depart from the spirit and scope of the invention are deemed to be covered by the invention which is limited only by the claims that follow.

I claim:

1. A structural panel having:

a first face sheet;

a second face sheet separated from said first face sheet; and a first plurality of separator webs positioned generally perpendicular to said first and second face sheets and connected to said face sheets to maintain the separation thereof, each of said first plurality of separator webs having:

first and second sides;

a centerline bulge there along generally centered between said first and second face sheets and extending from said first and second sides;

at least one gas passage through said centerline bulge;

a first diagonal web extending between said first side of said centerline bulge and said first face sheet;

a second diagonal web extending between said first side of said centerline bulge and said second face sheet;

a third diagonal web extending between said second side of said centerline bulge and said first face sheet; and a fourth diagonal web extending between said second side of said centerline bulge and said second face sheet, wherein each diagonal web cooperates with said separator web and said respective face sheet to define a void having a right triangular shape in cross-section.

2. The structural panel as defined in claim 1 wherein said first plurality of webs are separated from each other a distance smaller that the separation of said first and second face sheets.

3. The structural panel as defined in claim 2 wherein said first and fourth diagonal webs are parallel to each other, and said second and third diagonal webs are parallel to each other.

4. The structural panel as defined in claim 3 wherein each of said diagonal webs include:

at least one gas passage there through.

5. The structural panel as defined in claim 3 wherein said face sheets have:

a first average thickness, and said diagonal webs have:

a second average thickness less than said first average thickness of said face sheets.

6. The structural panel as defined in claim 1 wherein each of said first plurality of separator webs have further:

a fifth diagonal web extending between said first side of said centerline bulge adjacent said first diagonal web and said first face sheet at a location spaced from said first diagonal web;

a sixth diagonal web extending between said first side of said centerline bulge adjacent said second diagonal web and said second face sheet at a location spaced from said second diagonal web;

a seventh diagonal web extending between said second side of said centerline bulge adjacent said third diagonal web and said first face sheet at a location spaced from said third diagonal web; and a eighth diagonal web extending between said second side of said centerline bulge adjacent said fourth diagonal web and said second face sheet at a location spaced from said fourth diagonal web.

7. The structural panel as defined in claim 6 wherein each of said diagonal webs include:

at least one hole there through.

8. The structural panel as defined in claim 1 further including:

a second plurality of separator webs positioned generally perpendicular to said first and second face sheets and at an angle to said first plurality of separator webs, said second plurality of separator webs being connected to said face sheets to maintain the separation thereof, each of said second plurality of separator webs having:

first and second sides;

a centerline bulge there along generally centered between said first and second face sheets and extending from said first and second sides;

at least one hole through said web centerline bulge;

a first diagonal web extending between said first side of said centerline bulge and said first face sheet;

a second diagonal web extending between said first side of said centerline bulge and said second face sheet;

a third diagonal web extending between said second side of said centerline bulge and said first face sheet; and a fourth diagonal web extending between said second side of said centerline bulge and said second face sheet, said first and third diagonal webs of said second plurality of separator joining with said first and third diagonal webs of said first plurality of separator webs to form first truncated pyramids having apexes connected to said first face sheet, and said second and fourth diagonal webs of said second plurality of separator joining with said second and fourth diagonal webs of said first plurality of separator webs to form second truncated pyramids having apexes connected to said second face sheet.

9. The structural panel as defined in claim 8 wherein each of said truncated pyramids include:

at least one gas passage there through.

10. A structural panel comprising:

a first face sheet;

a second face sheet spaced apart from said first face sheet;

a plurality of separator webs extending between and perpendicular to said first and second face sheets; and a first reinforcement sheet extending through a medial portion of said separator web, wherein said first reinforcement sheet is operably attached to said first face sheet on each side of said separator web to thereby form first and second diagonal webs between said separator web and said first face sheet, and wherein each of said first and second diagonal webs cooperates with said separator web and said first face sheet to define a triangular void in cross-section.

11. A structural panel according to claim 10 further comprising a second reinforcement sheet extending through a medial portion of said separator web, wherein said second reinforcement sheet is operably attached to said second face sheet on each side of said separator web to thereby form third and fourth diagonal webs between said separator web and said second face sheet, and wherein each of said third and fourth diagonal webs cooperates with said separator web and said second face sheet to define a triangular void in cross-section.

12. A structural panel according to claim 10 wherein each said diagonal web defines a gas passage for pressure equalization.

13. A structural panel according to claim 10 wherein each separator web comprises a centerline bulge through which said first reinforcement sheet extends.

14. A structural panel according to claim 10 wherein each separator web defines a gas passage through said centerline bulge for pressure equalization.

* * * * *